United States Patent [19]

Grant

[11] 4,102,254

[45] Jul. 25, 1978

[54] EXHAUST DISPOSAL SYSTEM

[76] Inventor: James L. Grant, 353 Tompkins Ave., Brooklyn, N.Y. 11216

[21] Appl. No.: 756,914

[22] Filed: Jan. 4, 1977

[51] Int. Cl.[2] ..... F23J 11/00

[52] U.S. Cl. ..... 98/115 R; 104/52

[58] Field of Search ..... 98/115 R; 74/25, 219, 74/421 A; 104/52; 141/98, 181, 182; 134/45, 123; 15/DIG. 2

[56] References Cited

U.S. PATENT DOCUMENTS

| | | | |
|---|---|---|---|
| 1,390,950 | 9/1921 | Avery | 104/52 |
| 1,679,705 | 8/1928 | Baumgärtel | 104/52 |
| 1,791,640 | 2/1931 | Rodin | 104/52 |
| 2,166,591 | 7/1939 | Hollister | 104/52 |
| 2,598,884 | 6/1952 | Brady, Jr. | 104/52 |
| 2,733,668 | 2/1956 | Pfetzing | 104/52 |
| 2,765,752 | 10/1956 | Imming | 104/52 |
| 2,990,198 | 6/1961 | Imming | 104/52 |
| 3,321,793 | 5/1967 | Braunger | 134/45 |
| 3,473,462 | 10/1969 | Imming | 98/115 R |
| 3,492,937 | 2/1970 | Ambli | 104/52 |

*Primary Examiner*—Ronald C. Capossela
*Attorney, Agent, or Firm*—A. J. Castorina

[57] ABSTRACT

A vehicle exhaust fume removal system for garages, including a movable conduit having an inlet adapted to be disposed adjacent to a vehicle exhaust pipe, and an outlet adapted to be disposed outwardly of the garage to thereby conduct the fumes into the atmosphere. The movement of the conduit is controlled in response to the position of the vehicle or a part thereof whereby the vehicle can be started in inclement weather without subjecting the driver to the inconvenience of opening the garage doors to vent the fumes.

8 Claims, 5 Drawing Figures

EXHAUST DISPOSAL SYSTEM

BACKGROUND OF THE INVENTION

Several systems are known in the prior art relating to the venting of exhaust fumes from an enclosed building and these generally constitute or include the use of exhaust fans strategically located in the vicinity of the vehicle. The serious drawback of this is the fact that the fumes are drawn through an open area defining the fume outlet and the entrance of the fan. These systems do not concern themselves with confining the fumes and therefore are exposed, and detrimental to a person standing in the path of movement.

Therefore, it is an object of the present invention to provide an exhaust system which functions automatically to confine the exhaust fumes and conduct the same into the atmosphere.

It is another object of the invention to provide an exhaust system which is easily installed, adjustable to accommodate space requirements readily maintained and comprised of relatively few parts.

SUMMARY OF THE INVENTION

A conduit is disposed in a trench in a garage generally transversely to the direction of the vehicle and is aligned with the outlet of the exhaust pipe thereof when moved out of the trench upon actuation of control means therefor. The opposite end of the conduit opens to the atmosphere to conduct the exhaust fumes from the vehicle.

DESCRIPTION OF THE PREFERRED EMBODIMENTS

Figure 1:
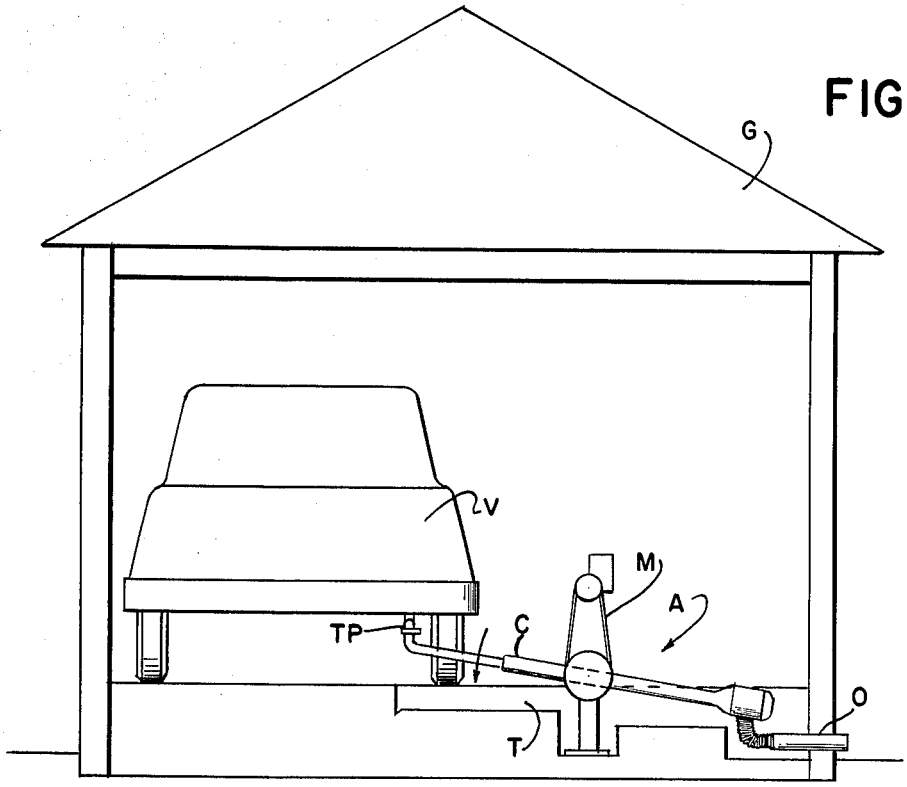
FIG. 1 shows the rear of a vehicle disposed in a shelter with the exhaust fume conducting means associated with the tailpipe thereof.

With reference to FIG. 1, the fume exhaust conducting means of the invention is depicted, generally as A, associated with the tailpipe, TP, of the vehicle V, housed in a garage G. The garage doors have been removed for purposes of clarity, but it is to be understood that the primary function of the invention is to conduct the vehicle fumes away from within a closed housing. As is seen, the conduit means C of the exhaust conducting means is normally positioned within a trench T, and is selectively moved upwardly by actuating means M, into a tailpipe engaging position as will be explained hereinafter. The outlet end of the conduit means C, is positioned in an opening O, provided in the housing to conduct fumes to the atmosphere.

Figure 2:
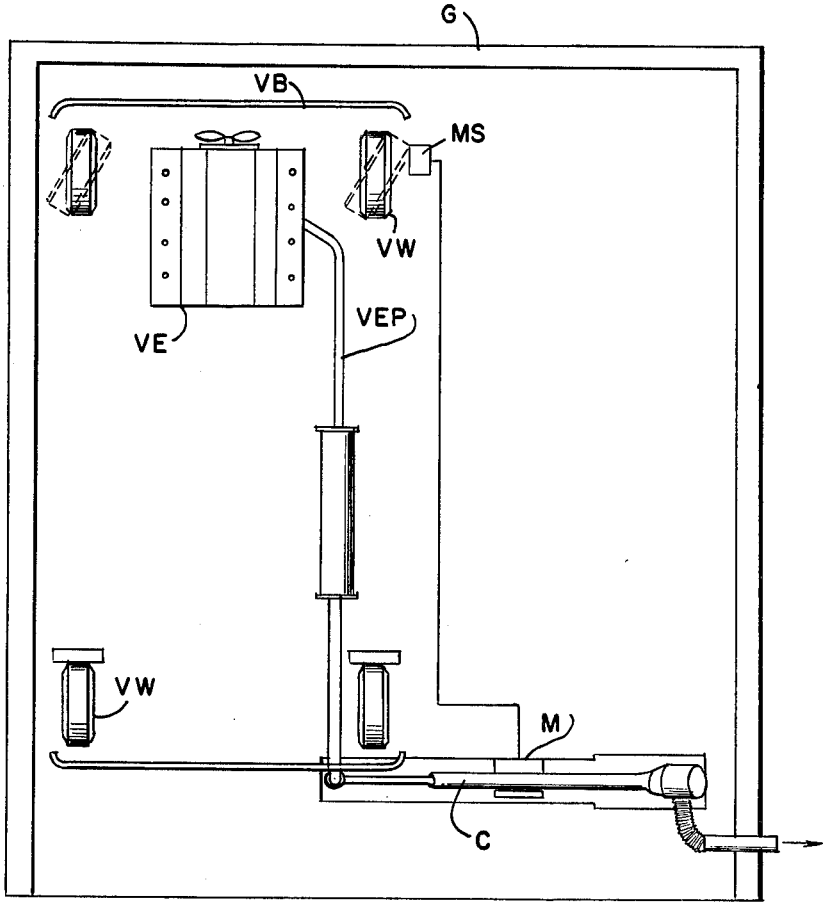
FIG. 2 is a top view of FIG. 1 with selected vehicle parts being shown in association with the fume conducting means.

FIG. 2 shows a top view of the fume exhaust means A, and its association with the Vehicle V, having its body removed to expose the wheels $V_W$, engine $V_E$, bumper $V_B$ and its exhaust pipe $V_{EP}$.

It is to be further noted that the front wheels are turned with one of the same engaging a micro-switch $M_S$ which is electrically connected to the actuating means M and causes the same to be energized to move the fume exhaust conduit C upwardly into proximity with the tailpipe TP, in a manner as will be explained hereinafter.

Figure 3:
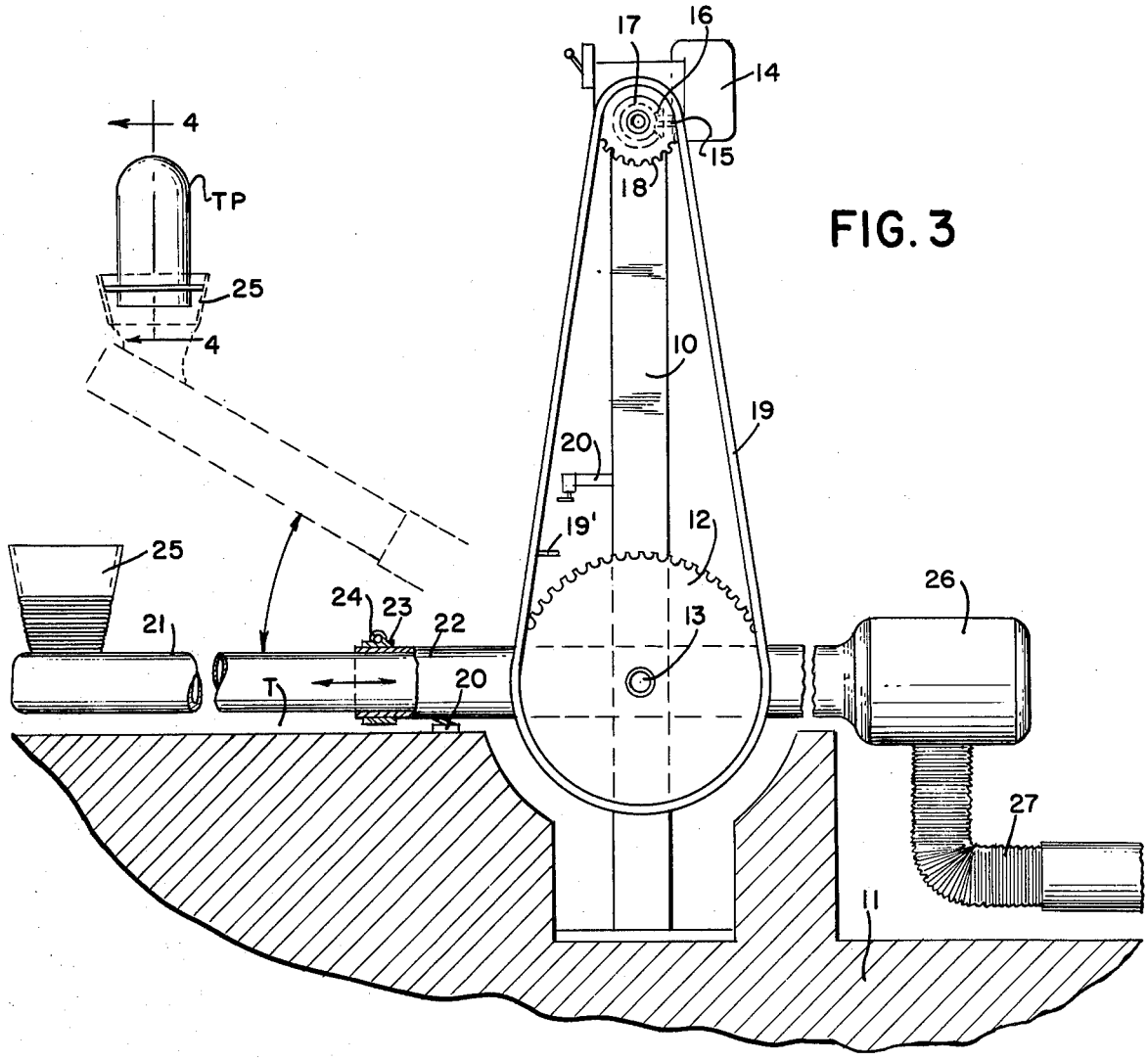
FIG. 3 is a detailed view of the component parts of the fume conducting means.

The actuating means M, as seen in FIG. 3, is comprised of a support post 10 anchored in the floor 11 of the garage G, and has a gear 12 rotatably disposed at the lower end thereof at 13 and is fixedly connected to the conduit C at that point. A motor 14 is mounted at the upper end of the post 10, and its shaft 15 is provided with a gear 16 meshing with a gear 17 mounted on a separate shaft which in turn drives the gear 18. Gear 18 drives gear 12 via a lugged belt 19 and as is apparent, the rotation of the latter will cause the conduit C to move from its solid line position to the dotted line exhaust pipe engaging position and vice versa.

A stop 19' is disposed above the gear 12 and engages a micro-switch 20 mounted on the medial portion of the post 10, causing the motor to stop and thereby maintain the conduit C in a set exhaust pipe TP engaging position. To reverse the movement of the conduit C, the driver merely needs to straighten his front wheels $V_W$ to release the microswitch $M_S$ which in turn causes the motor 14 and the belt 19 to be driven in a reverse manner to lower the conduit C to its solid line position. A micro-switch 20 is located on the base of the trench T, beneath the conduit C, to stop the motor upon being engaged thereby.

With continuing reference to FIG. 3, the conduit means C, is seen to be comprised of a pair of telescoping pipes 21, 22 selectively locked to one another by a clamp 23 having tightening means 24.

The end of pipe 21 has a flexible ribbed cup-like member 25, extending upwardly and in communication therewith which is capable of collapsing about the ribs to accommodate the end of the exhaust pipe TP, as shown in dotted lines in FIG. 3. A blower 26 is provided at the free end of pipe 22 in axial alignment therewith and serves to draw the fumes through the coupled pipes 21, 22 and into the atmosphere through a discharge tube 27 positioned in garage opening O.

Figure 4:
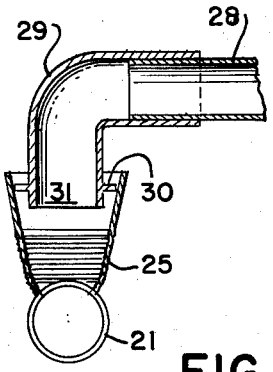
FIG. 4 is a sectional view taken on the line 4—4 of FIG. 3 showing the relationship between the outlet of the vehicle tailpipe and the entrance to the conduit means.

The tailpipe TP, see FIG. 4, is comprised of a plurality of tubes 28, 29 telescopingly engaged by a friction fit to accommodate space dimensions when installed. Tube 29 is L-shaped to facilitate its engagement with the cup-like member 25 and has an annular flange 30 adjacent the discharge opening 31, and seatingly cooperates with the interior of the cup 25 to prevent the exhaust fumes from passing into the interior of the garage G.

Figure 5:
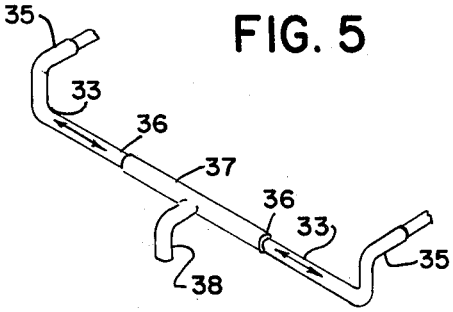
FIG. 5 shows an attachment for the exhaust means when dual tailpipes are involved.

In the case of vehicles provided with dual exhausts, an attachment 3L such as shown in FIG. 5 is utilized. A pair of generally L-shaped pipes 33, 34, have ends 35,35 which are adapted to be inserted into the exhaust pipes of the vehicles while the other ends 36, 36 are telescopingly inserted into a sleeve 37 having an elbow outlet 38 emanating therefrom. The outlet 38 is mated with the flexible cup 25 in the same fashion as discussed hereinabove relative to the tailpipe TP, outlet.

While the electrical circuits between the motor, the power supply, and the micro-switches are now shown, it is to be understood that due to the simplicity thereof, the same is deemed to be within the skill of a person versed in the art.

What I claim is:

1. An exhaust system for a vehicle or the like, including conduit means, said conduit means being movable from an inoperative position to an operative position, with said inoperative position being defined with one end of said conduit means being out of contact with an exhaust outlet and with said operative position being defined with said one end being in communication with said exhaust outlet, respectively, means moving said conduit means between said two positions, blower means associated with the other end of said conduit means for conducting exhaust fumes from said exhaust outlet therethrough and into the atmosphere, said moving means comprising a support, motor means mounted thereon, said motor means being driven from a source of electric power, switch means energizing said motor means, lifting means disposed between said motor means and said conduit means, including a first member being driven by said motor means and being in driving relationship with a second member mounted on said conduit means whereby rotation of the first member causes said conduit means to move from said inoperative to said operative position, said lifting means comprising an endless member disposed between said first and second members having a lug thereon and a limit switch electrically connected to said motor means engageable by said lug to stop the motor.

2. The combination of claim 1 wherein the motor means is mounted on said support and the conduit means is pivotally disposed on a lower portion thereof.

3. The combination of claim 1 wherein the motor means is energized in response to a vehicle wheel engaging a switch means positioned adjacent thereto.

4. The combination of claim 1 wherein the conduit means includes telescoping pipes for accommodating varying distances between said exhaust outlet and said support.

5. The combination of claim 1 wherein a collapsible member is disposed on one end of said conduit means and is adapted to conform to the outlet shape of said exhaust.

6. The combination of claim 1 wherein second switch means are disposed beneath the conduit means to limit the movement toward the inoperative position by de-energizing the motor means.

7. The combination of claim 1 wherein the conduit means is provided with two inlets to accommodate itself to a vehicle having dual exhaust means.

8. The combination of claim 1 wherein the conduit means is disposed in a recess in its inoperative position to permit a vehicle pass thereover.

* * * * *